US011780707B1

(12) United States Patent
de Ledebur et al.

(10) Patent No.: US 11,780,707 B1
(45) Date of Patent: Oct. 10, 2023

(54) CABIN GUIDE

(71) Applicants: Juan Carlos G de Ledebur, Key Biscayne, FL (US); Carlos M. Ascua, Entre Rios (AR)

(72) Inventors: Juan Carlos G de Ledebur, Key Biscayne, FL (US); Carlos M. Ascua, Entre Rios (AR)

( * ) Notice: Subject to any disclaimer, the term of this patent is extended or adjusted under 35 U.S.C. 154(b) by 0 days.

(21) Appl. No.: 18/322,697

(22) Filed: May 24, 2023

(51) Int. Cl.

| | |
|---|---|
| ***B66B 7/02*** | (2006.01) |
| ***B66B 7/04*** | (2006.01) |
| *B66B 11/02* | (2006.01) |
| *B66B 9/04* | (2006.01) |

(52) U.S. Cl.
CPC ..... *B66B 7/023* (2013.01); *B66B 7/047* (2013.01); *B66B 7/048* (2013.01); *B66B 9/04* (2013.01); *B66B 11/0206* (2013.01)

(58) Field of Classification Search
CPC ..... B66B 7/04; B66B 7/047; B66B 7/048; B66B 7/08; B66B 7/10
See application file for complete search history.

(56) References Cited

U.S. PATENT DOCUMENTS

| | | | | | |
|---|---|---|---|---|---|
| 1,076,273 | A * | 10/1913 | Dunlap | B66B 7/047 | 16/93 R |
| 2,601,503 | A * | 6/1952 | Cornish | B66B 7/047 | 187/409 |
| 5,611,412 | A * | 3/1997 | Yoo | B66B 7/10 | 187/412 |
| 10,233,055 | B1 | 3/2019 | Ascua et al. | | |
| 10,351,388 | B2 | 7/2019 | Ascua et al. | | |
| 2015/0291396 | A1 * | 10/2015 | Nakamura | B66B 7/048 | 187/404 |

FOREIGN PATENT DOCUMENTS

| | | | | |
|---|---|---|---|---|
| CN | 1263861 | A * | 8/2000 | B66B 7/047 |
| CN | 109552965 | A * | 4/2019 | |
| CN | 115258880 | A * | 11/2022 | |
| ES | 2400646 | A2 * | 4/2013 | B66B 7/047 |

* cited by examiner

*Primary Examiner* — Minh Truong
(74) *Attorney, Agent, or Firm* — Christopher & Weisberg, P.A.

(57) ABSTRACT

A cabin guide assembly is described. The cabin guide assembly includes a material layer that has a first material layer surface and a guide that has a first guide surface and a second guide surface opposite the first guide surface. The second guide surface is coupled to the first material layer surface. The cabin guide assembly further includes a base coupled to at least a portion of the first guide surface and one or more adjustment members coupled to the base and arranged to exert an adjustable force against the guide and the material layer.

17 Claims, 15 Drawing Sheets

CABIN GUIDE

TECHNICAL FIELD

The present technology is generally related to vacuum elevator components, and more specifically to elevator cabin guides for controlling displacement of elevator cabins.

BACKGROUND

Elevators are typically used to transport people and goods between two or more floor levels of a building, house, ship, etc. Elevators may comprise a cabin (i.e., car) that is generally used to transport the people and goods between floors. When the cabin is put in motion, the cabin travels within an unobstructed space. The unobstructed space may be referred to as elevator well. The elevator well and the cabin may comprise one or more elements of the elevator system, e.g., depending on the type of elevator. Some types of elevators include traction elevators, hydraulic elevators, and vacuum elevators. Traction elevators require the use of cables, motors, weights, etc. Hydraulic elevators require the use of complex hydraulic systems including pistons, hydraulic fluid, hydraulic pumps, etc. Generally, vacuum elevators do not require the complexity of traction and hydraulic elevators.

More specifically, a vacuum elevator may have a cabin that travels up and down an outer structure using rails and guides. To move the cabin upwards, a vacuum system is used. The vacuum system extracts air from the unobstructed space above the cabin, thereby creating a vacuum or a low pressure space. The difference between the pressure of air above the cabin and the pressure of air below the cabin forces the elevator to move upwards. Typically, the downwards movement of the vacuum elevator relies on gravity (i.e., without the use of the vacuum system). To create the suction, the elevator (e.g., comprising the unobstructed space and cabin) is sealed to prevent air leaks.

For vacuum elevators, it is important to limit the cabin movement to vertical movement. Cabin movement other than vertical (e.g., side to side) may result in air leaks around the cabin, a rugged feel during when the cabin is ascending or descending, etc.

SUMMARY

Some embodiments provide a cabin guide assembly, which may be coupled to one or more cabin columns. The cabin guide assembly may be arranged to keep the cabin on a predetermined path during its movement within the elevator (e.g., or in a location when the cabin is not vertically moving). One or more embodiments are beneficial at least because safety of the elevator is improved (e.g., when compared to conventional systems). Further, the cabin guide assembly may keep the cabin aligned and stable, thereby providing a smooth ride.

In one or more embodiments, an elevator comprises a plurality of elevator columns (e.g., four elevator columns). Further, the cabin may comprise cabin columns (e.g., dual cabin columns). Each cabin column may comprise one or more cabin guide assemblies, such as one positioned towards the top of the cabin column and the other towards the bottom. In some embodiments, the cabin comprises eight elevator guide assemblies. Each of the elevator guide assemblies may help maintain the cabin aligned and stable in the elevator.

In one aspect, the present disclosure provides a cabin guide assembly. The cabin guide assembly includes a material layer that has a first material layer surface and a guide that has a first guide surface and a second guide surface opposite the first guide surface. The second guide surface is coupled to the first material layer surface. The cabin guide assembly further includes a base coupled to at least a portion of the first guide surface and one or more adjustment members coupled to the base and arranged to exert an adjustable force against the guide and the material layer.

In another aspect, the disclosure provides a cabin guide assembly. The cabin guide assembly includes a material layer, a guide, a base, a support plate, and one or more adjustment members. The material layer has a first material layer surface. The guide has a first guide surface and a second guide surface opposite the first guide surface. The second guide surface is coupled to the first material layer surface. The base is coupled to at least a portion of the first guide surface and includes one or more base openings. The support plate has one or more support plate openings. The one or more adjustment members are inserted through a corresponding base opening and a corresponding support plate opening. The one or more adjustment members is coupled to the base and arranged to exert an adjustable force against the guide and the material layer.

In one aspect, the disclosure provides an elevator comprising an elevator structure, a cabin, and a plurality of cabin guide assemblies. The elevator structure includes a plurality of elevator columns, where each elevator column of the plurality of elevator columns includes a column rail. The cabin is movable within the elevator structure. Each cabin guide assembly of the plurality of cabin guide assemblies is coupled to the cabin and includes a material layer, a guide, a base, a support plate, and one or more adjustment members. The material layer has a first material layer surface and a second material layer surface opposite the first material layer surface. The second material layer surface is arranged to contact receive and contact a corresponding column rail. The guide has a first guide surface and a second guide surface opposite the first guide surface, where the second guide surface is coupled to the first material layer surface. The base is coupled to at least a portion of the first guide surface and includes one or more base openings. The support plate is coupled to the cabin and has one or more support plate openings. The one or more adjustment members are inserted through a corresponding base opening and a corresponding support plate opening. The one or more adjustment members are coupled to the base and arranged to exert an adjustable force against the guide and the material layer. At least a portion of the second material layer surface contacts and presses against the corresponding column rail when the adjustable force is exerted.

The details of one or more aspects of the disclosure are set forth in the accompanying drawings and the description below. Other features, objects, and advantages of the techniques described in this disclosure will be apparent from the description and drawings, and from the claims.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
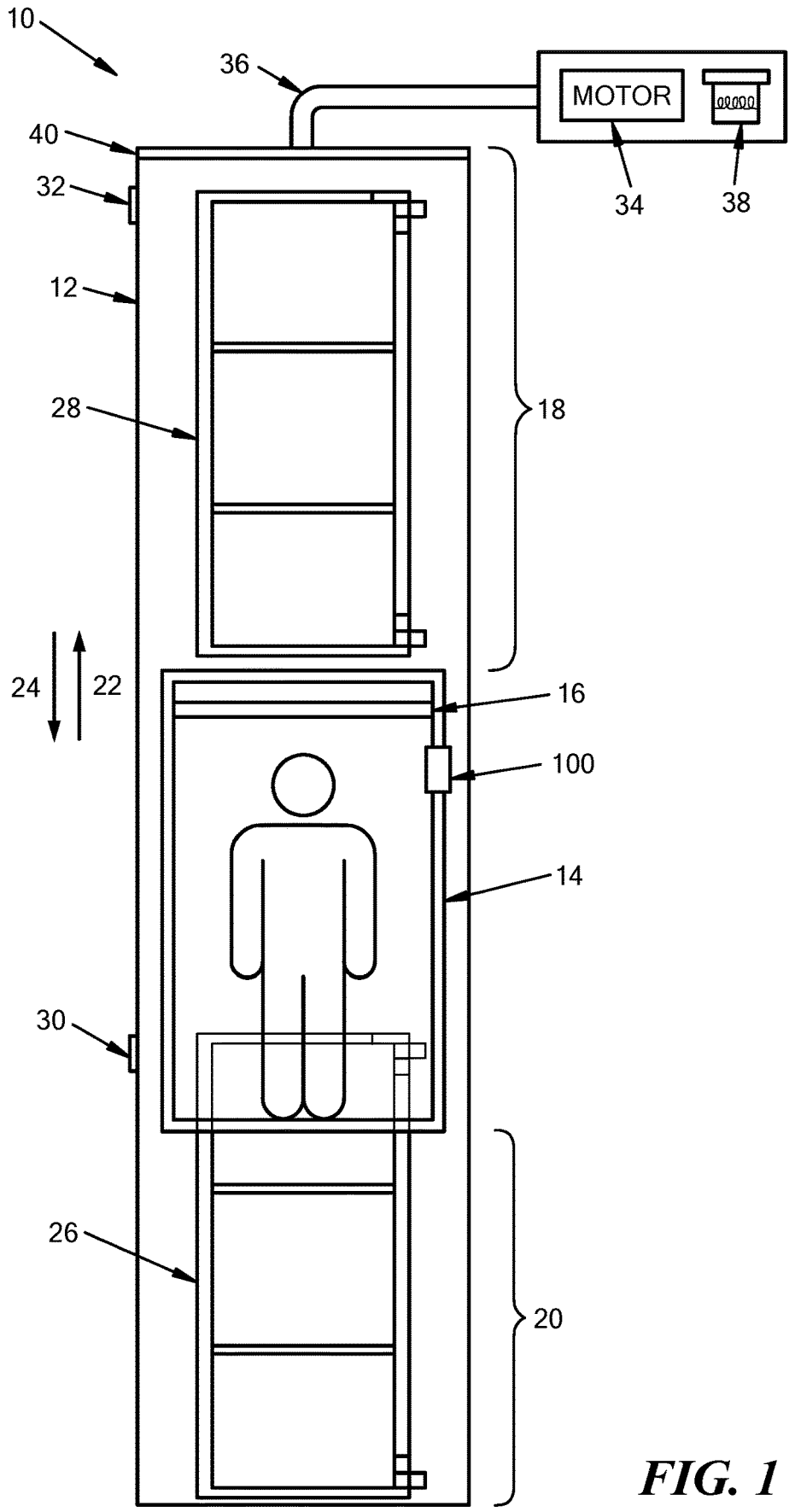
FIG. 1 shows an example elevator (e.g., elevator system) according to one or more embodiments of the present disclosure.

Before describing in detail exemplary embodiments, it is noted that the embodiments reside primarily in combinations of apparatus components and processing steps related to an adjustable seal (e.g., elevator cabin seal). Accordingly, components have been represented where appropriate by conventional symbols in the drawings, showing only those specific details that are pertinent to understanding the embodiments so as not to obscure the disclosure with details that will be readily apparent to those of ordinary skill in the art having the benefit of the description herein. Like numbers refer to like elements throughout the description.

As used herein, relational terms, such as "first" and "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

In some embodiments described herein, the term "coupled," "connected," "attached" and the like, may be used herein to indicate a coupling of two or more elements or components, although not necessarily directly. It should be understood that various aspects disclosed herein may be combined in different combinations than the combinations specifically presented in the description and accompanying drawings. It should also be understood that, depending on the example, certain acts or events of any of the processes or methods described herein may be performed in a different sequence, may be added, merged, or left out altogether (e.g., all described acts or events may not be necessary to carry out the techniques). In addition, while certain aspects of this disclosure are described as being performed by a single module or unit for purposes of clarity, it should be understood that the techniques of this disclosure may be performed by a combination of units or modules associated with, for example, an elevator.

Referring now to the drawing figures in which like reference designators refer to like elements, FIG. 1 shows an example elevator 10 (e.g., elevator system) according to one or more embodiments of the present disclosure. Elevator 10 may include one or more components such as elevator walls 12, cabin 14, cabin top portion 16, top space 18, bottom space 20, first floor door 26, second floor door 28, first floor sensor 30, second floor sensor 32, motor 34, pipe 36, and valve 38. More specifically, elevator 10 is arranged such that cabin 14 moves up in ascent direction 22 and moves down in descent direction 24. The elevator walls 12 form an internal space including at least cabin 14, top space 18, and bottom space 20. Motor 34 may be arranged as a turbine that evacuates air from the internal space (e.g., top space 18) via pipe 36. The motor 34 may use valve 38 (e.g., to control suction, vacuum, etc.). To move the cabin in the ascent direction 22, motor 34 is energized and air from the top space 18 is evacuated (i.e., suctioned out) to the exterior of elevator 10. The suction creates an air pressure in top space 18 that is lower than the air pressure in bottom space 20. The pressure differential causes cabin 14 to move in the ascent direction 22. Cabin 14 may be arranged to descend in the descent direction 24 by gravity (e.g., without the use of motor 34, suction, vacuum, etc.).

First and second floor sensors 30, 32 are configured to detect that cabin 14 has reached the first and the second floors, respectively. First and second floor doors 26, 28 are coupled (e.g., sealed to) elevator walls 12 and arranged to open to allow elevator passengers to enter and exit cabin 14, and to close to operate cabin 14 (e.g., ascend, descend). In some embodiments, elevator 10 and elevator walls 12 (and/or cabin 14, and/or first and second floor doors 26, 28) are cylindrical. However, elevator 10 (and/or any of its components) are not limited as such and may have any shape. In some embodiments, elevator 10 includes an elevator structure 40 (i.e., a plurality of elevator columns) arranged to structurally support elevator 10, e.g., columns are arranged to provide lateral, vertical support, gravity support, etc.

elevator structure 40 may be arranged to provide a guiding function to cabin 14 such as to guide the vertical movement of cabin 14. In some embodiments, elevator structure 40 may be coupled to elevator walls 12. Further, elevator 10 may include at least a cabin guide assembly 100 comprised in cabin 14 and arranged to contact and/or press against at least one component of elevator structure 40 (e.g., elevator columns and/or other elevator structure components). For example, cabin guide assembly 100 may be coupled to cabin 14 (e.g., and/or a component of cabin 14) and arranged to contact and/or press against elevator structure 40 (and/or a component of elevator structure 40) to guide cabin 14 such as during ascent, descent, or static operation.

Figure 2:
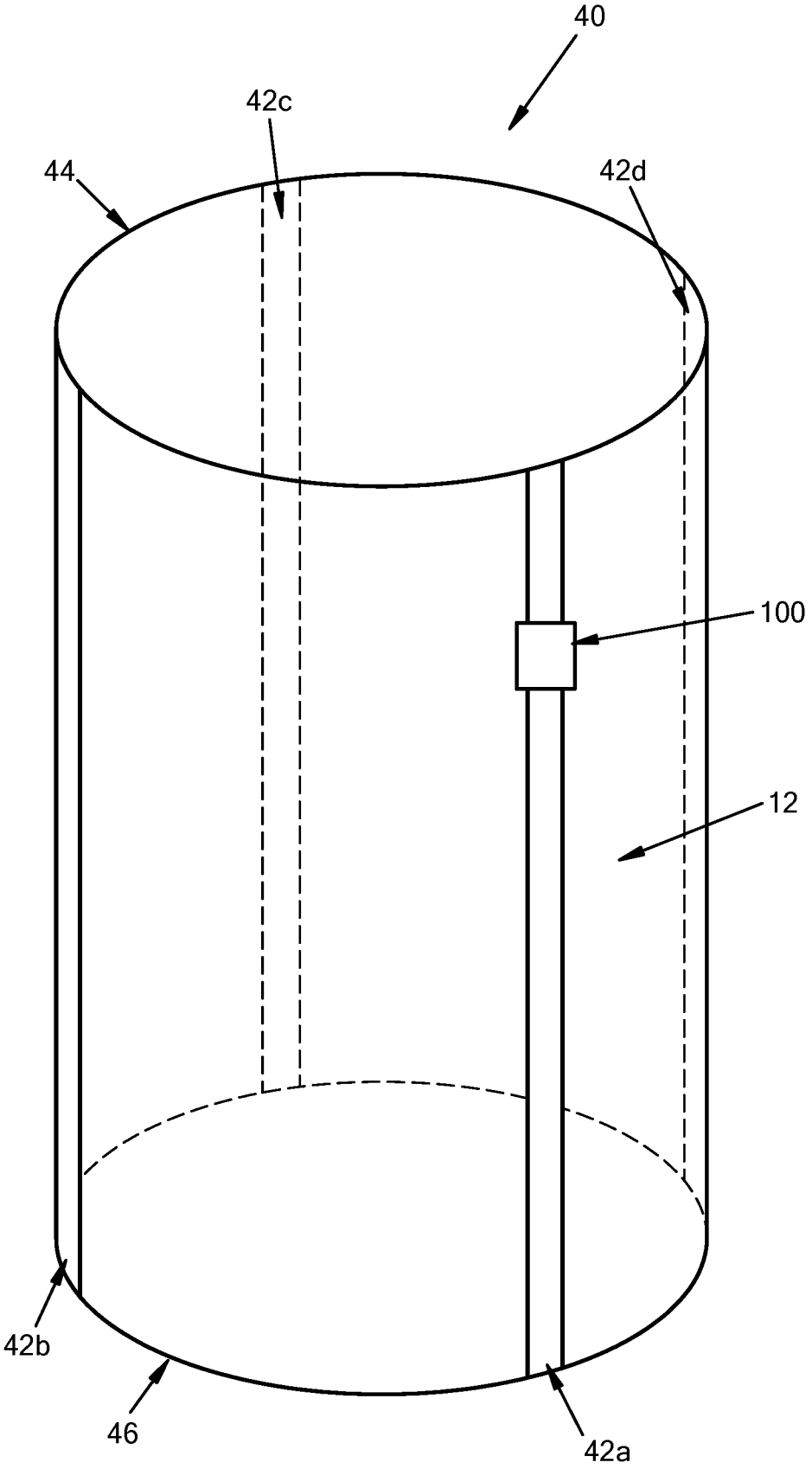
FIG. 2 shows an example elevator structure according to one or more embodiments of the present disclosure.

FIG. 2 shows an example elevator structure 40 according to one or more embodiments of the present disclosure. Elevator structure 40 may include elevator columns 42 (e.g., elevator columns 42*a*, 42*b*, 42*c*, 42*d*). Elevator columns 42 may be coupled to elevator walls 12 and/or top portion 44 and bottom portion 46 of elevator structure 40. Further, at least one cabin guide assembly 100 (e.g., attached to cabin 14) may be in contact and pressing against elevator column 42 (e.g., elevator column 42*a*). Although one cabin guide assembly 100 is shown, the present disclosure is not limited as such and may include any quantity of cabin guide assemblies 100. In a nonlimiting example, elevator 10 comprises two cabin guide assemblies 100 per elevator column 42, e.g., one cabin guide assembly 100 on a top portion of elevator column 42 and another in a bottom portion of elevator column 42. That is, an elevator 10 comprising elevator structure 40 as shown may comprise eight cabin guide assemblies 100, which allow the cabin guide assembly 100 (e.g., in conjunction with elevator column 42) to slide up and down, provide cabin alignment, etc.

Figure 3:
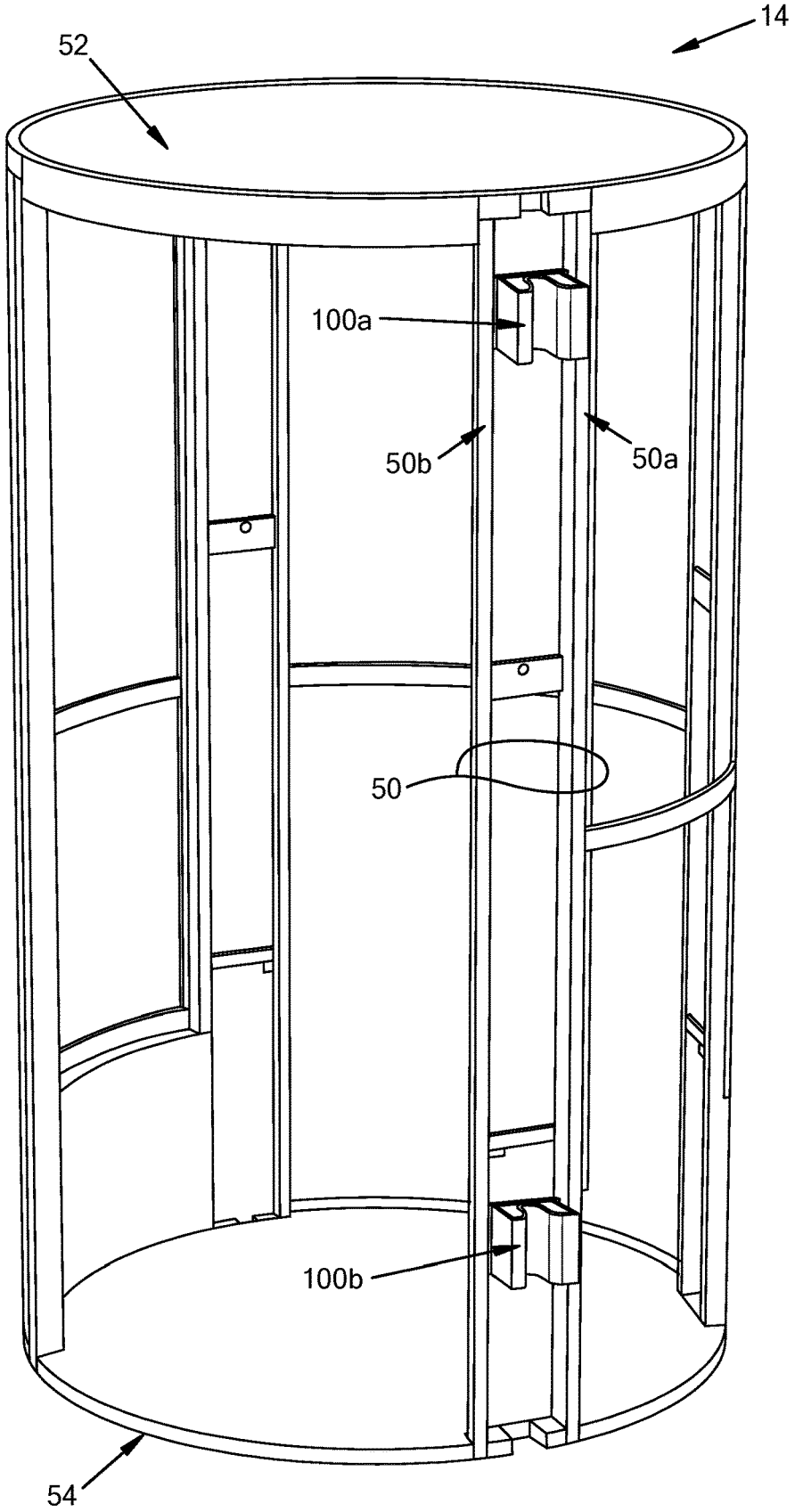
FIG. 3 shows an example cabin according to one or more embodiments of the present disclosure.

FIG. 3 shows an example cabin 14 according to one or more embodiments of the present disclosure. Cabin 14 includes a plurality of cabin columns 50 (e.g., cabin columns 50*a*, 50*b*, referred to collectively herein as cabin columns 50), which may be coupled to cabin ceiling 52 and cabin floor 54. Further, cabin 14 may comprise one or more cabin guide assemblies 100 (e.g., cabin guide assemblies 100*a*, 100*b*, referred to collectively herein as cabin guide assemblies 100). In some embodiments, cabin guide assembly 100*a* is coupled to cabin columns 50*a*, 50*b* (e.g., in proximity to cabin ceiling 52. In some other embodiments, cabin guide assembly 100*b* coupled to cabin columns 50*a*, 50*b* (e.g., in proximity to cabin floor 54). Each one of cabin guide assemblies 100 may be arranged to contact elevator structure 40 (i.e., corresponding elevator columns 42). That is, cabin 14 may be arranged to move vertically at least in part by each cabin guide assembly 100 sliding on a corresponding elevator column 42.

Figure 4:
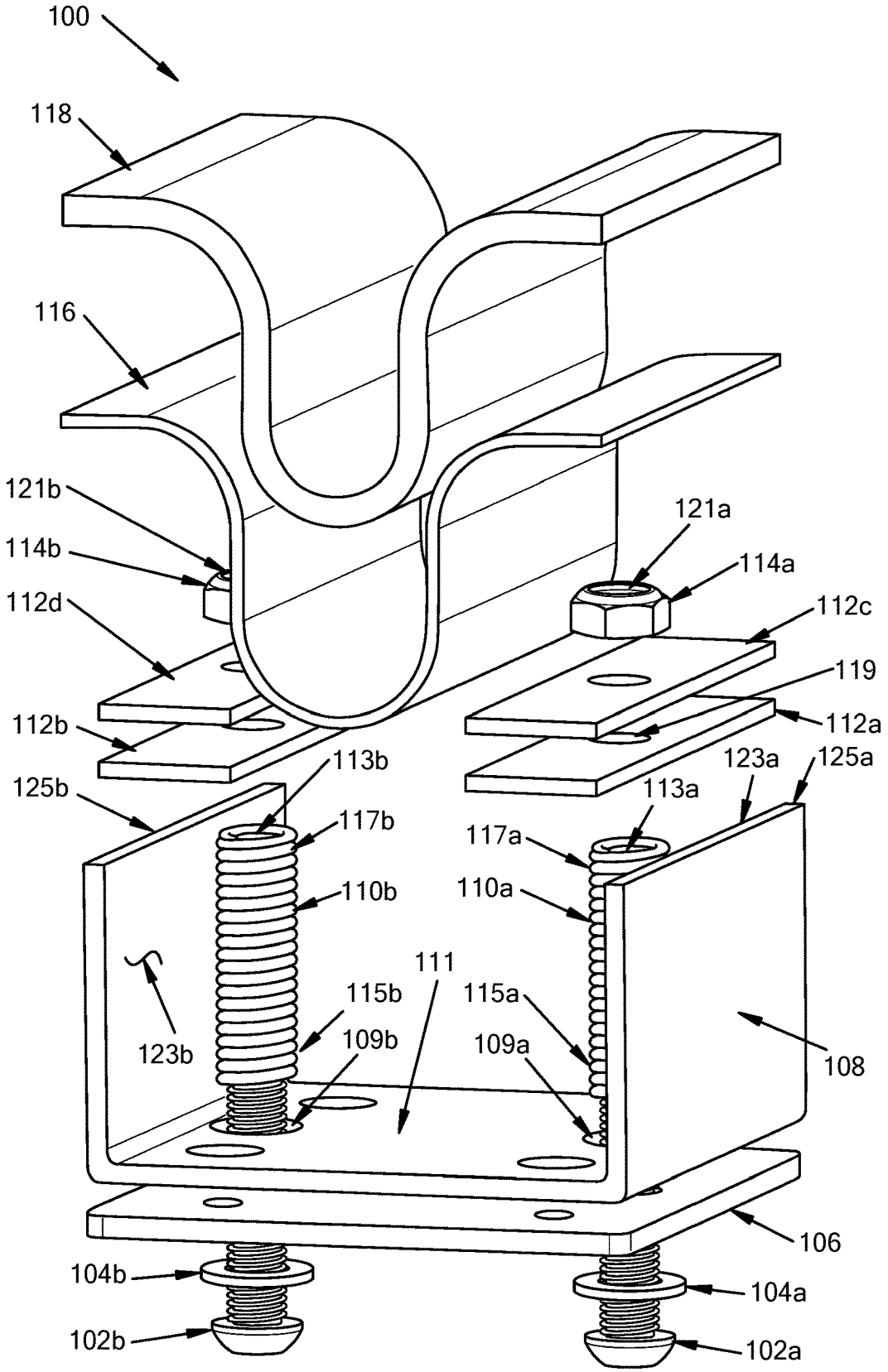
FIG. 4 shows an exploded view of an example cabin guide assembly according to one or more embodiments of the present disclosure.

FIG. 4 shows an exploded view of an example cabin guide assembly 100 according to one or more embodiments of the present disclosure. Cabin guide assembly 100 may include one or more of adjustable members, support plate 106, base 108 (e.g., U-shaped base), guide 116, and material layer 118 (e.g., U-shaped carpet). In some embodiments, each adjustable member includes a bolt 102, a washer 104, a spring 110, a nut 114 (and/or one or more bolt plates 112). Each bolt 102 has a bolt head, bolt tail, and a bolt threaded portion. Bolts 102*a*, 102*b* are insertable through washers 104*a*, 104*b*, support plate 106, base 108 (via base openings 109*a*, 109*b* on base surface 111), springs 110*a*, 110*b* (via spring interiors 113*a*, 113*b*, first spring ends 115*a*, 115*b*, second spring ends 117*a*, 117*b*), bolt plates 112 (via bolt plate opening 119), and nuts 114*a*, 114*b* (via nut openings 121*a*, 121*b*). Bolt plates 112 are couplable to base 108 (e.g., an interior side surface 123 of base 108). Guide 116 (e.g., U-shaped guide) is couplable to base 108 (e.g., to base to edge surfaces 125*a*, 125*b*). Material layer 118 may be coupled to guide 116 (e.g., using adhesive). The material layer may have a predetermined thickness, e.g., based on an energy absorption factor, friction component, etc.

In some embodiments, material layer 118 is a U-shaped carpet, which is inserted into guide 116. Guide 116 is a U-shaped steel frame. Nuts 114*a*, 114*b* are locknuts on either side of the cabin guide assembly 100 and are used to firmly tighten the bolts 102*a*, 102*b* into place. In some other embodiments, two bolt plates 112 (e.g., screw plates) are on each side of the cabin guide assembly 100. Bolt plates 112 (on each side) have a bolt plate opening 119 (e.g., centered hole), where the bolt 102 is inserted, and serve as support for the tightening functionality of nuts 121. In some embodiments, bolt plates 112 allow springs 110 to add tension to the piece, such as by securing cabin guide assembly 100 into the elevator column 42 of the elevator 10. In some embodiments, base 108 is a square-like U-shaped base arranged to bring components together, such as by allowing cabin guide assembly 100 to function as a single part. In some other embodiments, support plate 106 is a rear support plate, i.e., positioned behind the base 108. Support plate 106 may be arranged to couple to a cabin column 50 such as using bolts 102. Washers 104 are used on the bolts (e.g., between the bolt head and support plate 106, between first spring end 115 and base surface, between second spring end 117 and a bolt plate 112, between bolt plates 112, between a bolt plate 112 and nut 114, etc.). Washers 104 may be arranged to prevent damage such as to support plate surface or any other surface/component. Although two bolts 102, two washers 104, four bolt plates 112, two nuts 114, etc. are shown, the present disclosure is not limited as such, i.e., cabin guide assembly 100 may comprise any quantity of each component. Although bolts 102 are described, it is understood that other forms of adjustable fasteners, whether threaded or unthreaded, can be used in place of bolts 102 and nuts 114.

Figure 5:
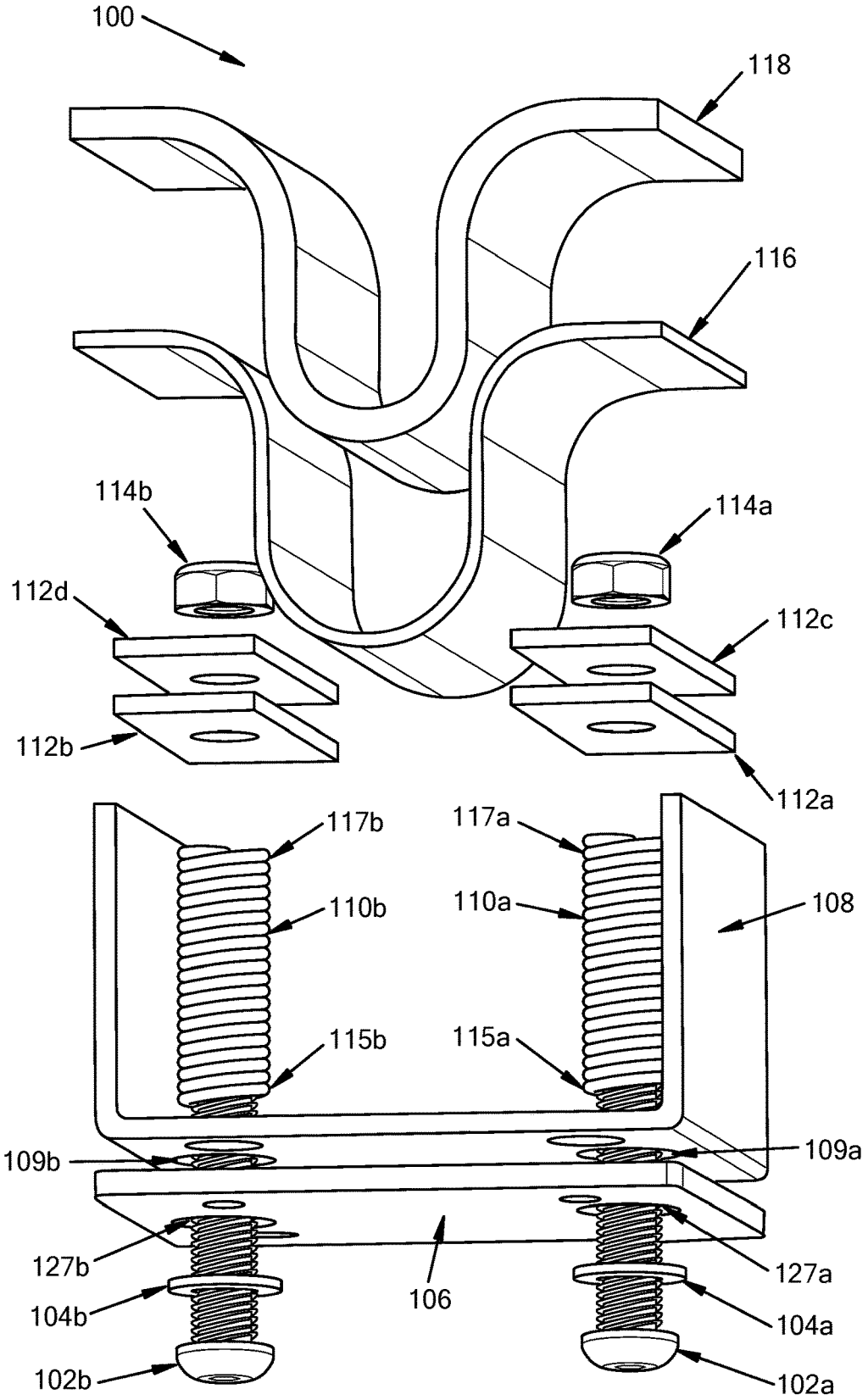
FIG. 5 shows another exploded view of the example cabin guide assembly according to one or more embodiments of the present disclosure.
Figure 6:
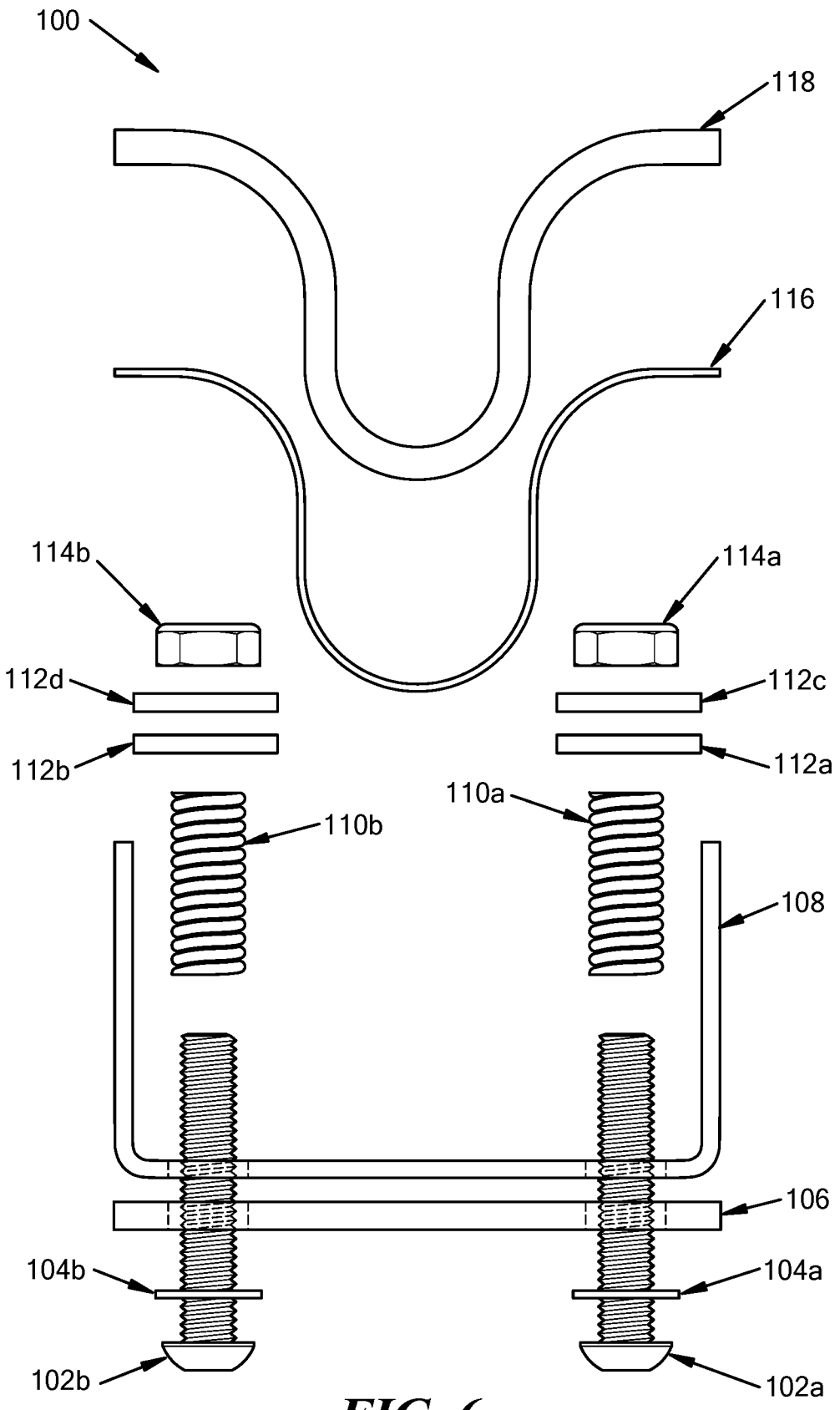
FIG. 6 shows yet another exploded view of the example cabin guide assembly according to one or more embodiments of the present disclosure.

FIG. 5 shows another exploded view of the example cabin guide assembly 100 according to one or more embodiments of the present disclosure. More specifically, in addition to the features shown in FIG. 4, support plate openings 127*a*, 127*b* are shown, which are arranged to receive bolts 102*a*, 102*b*, respectively. In some embodiments, support plate openings 127 are arranged to receive corresponding springs 110 such as to apply constant tension the to the cabin guide assembly 100. In some embodiments, springs 110 are received by base 108, i.e., not received by support plates openings 127, such as to apply constant tension the to the cabin guide assembly 100. In some other embodiments, springs 110 are positioning between any other components of cabin guide assembly 100 such as between bolt plates 112, where bolt plates 1012 are separated at least by spring 110. FIG. 6 shows yet another exploded view (e.g., top view) of the example cabin guide assembly according to one or more embodiments of the present disclosure.

Figure 7:
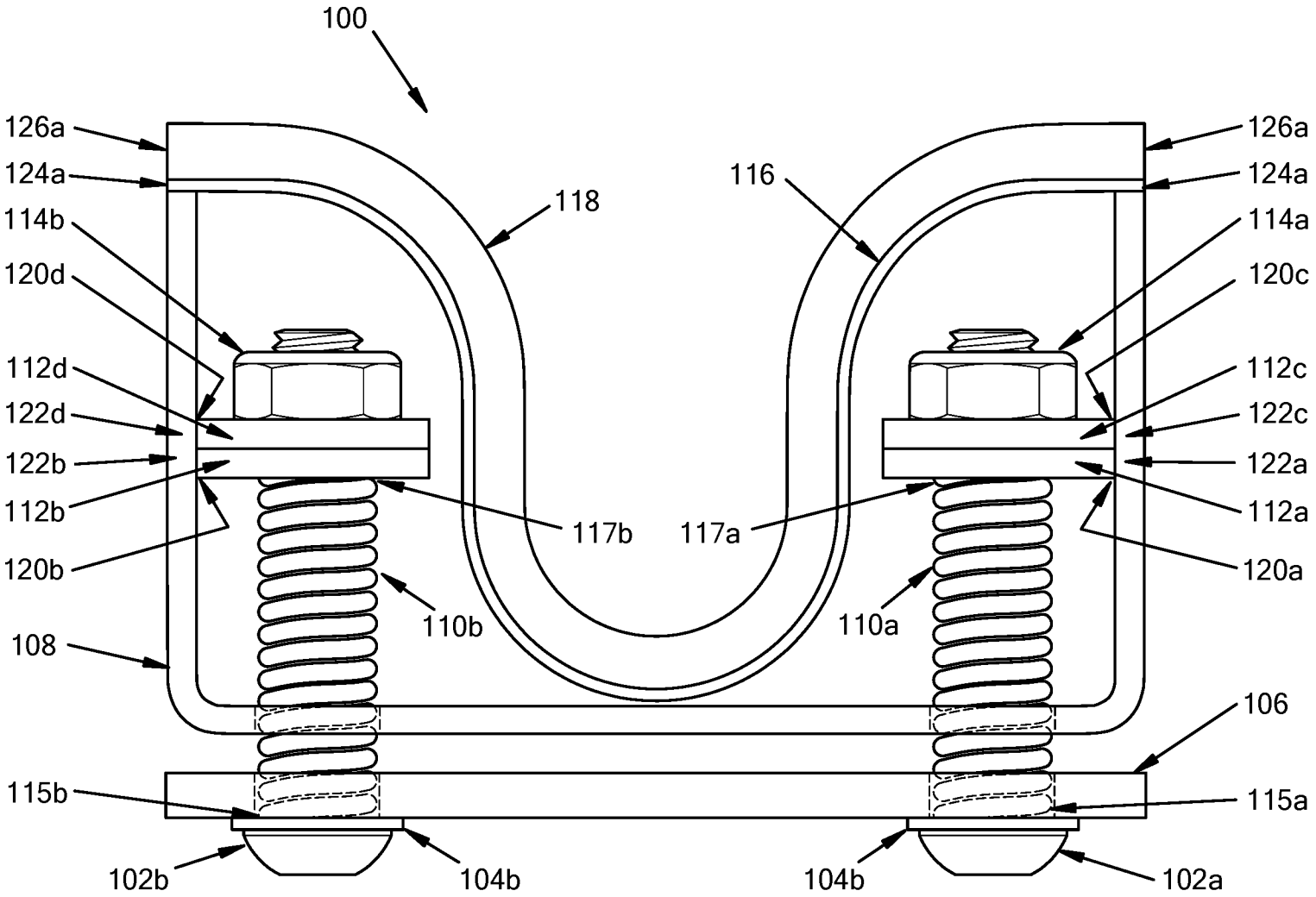
FIG. 7 shows a top view of the example cabin guide assembly (e.g., assembled) according to one or more embodiments of the present disclosure.

FIG. 7 shows a top view of the example cabin guide assembly that has been assembled. Cabin guide assembly 100 comprises one or more of plate coupler portions 120, base interior coupler portions 122, base end 124, and guide end 126. In some embodiments, bolt plate 112*a* is coupled to base 108 by coupling plate coupler portion 120*a* on bolt plate 112*a* to base interior coupler portion 122*a* of base 108. Bolt plate 112*a* is coupled to base 108 by coupling plate coupler portion 120*b* on bolt plate 112*b* to base interior coupler portion 122*b* of base 108. Bolt plate 112*c* is coupled to base 108 by coupling plate coupler portion 120*c* on bolt plate 112*c* to base interior coupler portion 122*c* of base 108. Bolt plate 112*d* is coupled to base 108 by coupling plate coupler portion 120*d* on bolt plate 112*d* to base interior coupler portion 122*d* of base 108. In some embodiments, plate coupler portion 120 and base interior coupler portion 122 may be arranged to releasably couple to each other. In some other embodiments, plate coupler portion 120 and base interior coupler portion 122 may be a single unitary construction such as integrated, welded, formed, etc.

In some other embodiments, base end 124 and guide end 126 may be arranged to couple to each other. In some embodiments, base end 124 and guide end 126 may be arranged to releasably couple to each other. In some other embodiments, base end 124 and guide end 126 may be a single unitary construction such as integrated, welded, formed, etc. In a nonlimiting example, base end 124*a* is coupled to guide end 126*a* (e.g., the coupling is a weld), and base end 124*b* is coupled to guide end 126*b* (e.g., the coupling is a weld). In some other embodiments, material layer 118 is bonded to guide 116 such as by using an adhesive.

In some embodiments, bolts 102*a*, 102*b* are fastened such as by tightening nuts 114*a*, 114*b*, respectively. Bolts 102*a*, 102*b* are spring loaded by springs 110*a*, 110*b*, i.e., bolts 102*a*, 102*b* are each positioned in spring interiors 113*a*, 113*b*, respectively. First spring ends 115*a*, 115*b* are in contact with washers 104*a*, 104*b*, respectively, and second spring ends 117*a*, 117*b* are in contact with bolt plates 112*a*, 112*b*, respectively. That is, spring 110*a* is compressed in between the washer 104*a* and bolt plate 112*a*. Similarly, spring 110*b* is compressed in between the washer 104*b* and bolt plate 112*b*. Bolt plates 112 are coupled to base 108. In some embodiments, bolt plates 112 are welded to base 108. As each spring 110 pushes against the corresponding bolt plate 112 (and washer 104), tension is provided to push the base 108 (and/or guide 116 and/or material layer 118) into the corresponding elevator column 42 (and/or column rail 130 (shown in FIG. 8)), creating a snug fit. In other embodiments, first spring ends 115*a*, 115*b* are in contact with and push against other components of cabin guide assembly 100 (e.g., support plate 106 or base surface 111). That is, springs 110*a*, 110*b* can create tension by having first spring ends 115*a*, 115*b* push against support plate 106 (or base surface 111) and second spring ends 117*a*, 117*b* contact and push against bolt plates 112*a*, 112*b*, respectively.

In some other embodiments, material layer 118 is a U-shaped resilient fabric/material such as carpet that is affixed to guide 116 that is a U-shaped frame. Bolt plates 112*a*, 112*c* (and 112*b*, 112*d*) are welded onto either side the square-like U-shaped base 108 (e.g., at plate coupler portions 120, base interior coupler portions 122, base end 124, and guide end 126). In some embodiments, guide 116 and material layer 118 are arranged as a unitary construction such as a unified U-shaped carpet with its steel base. The unitary construction is then welded onto the square-like U-shaped base 108.

Figure 8:
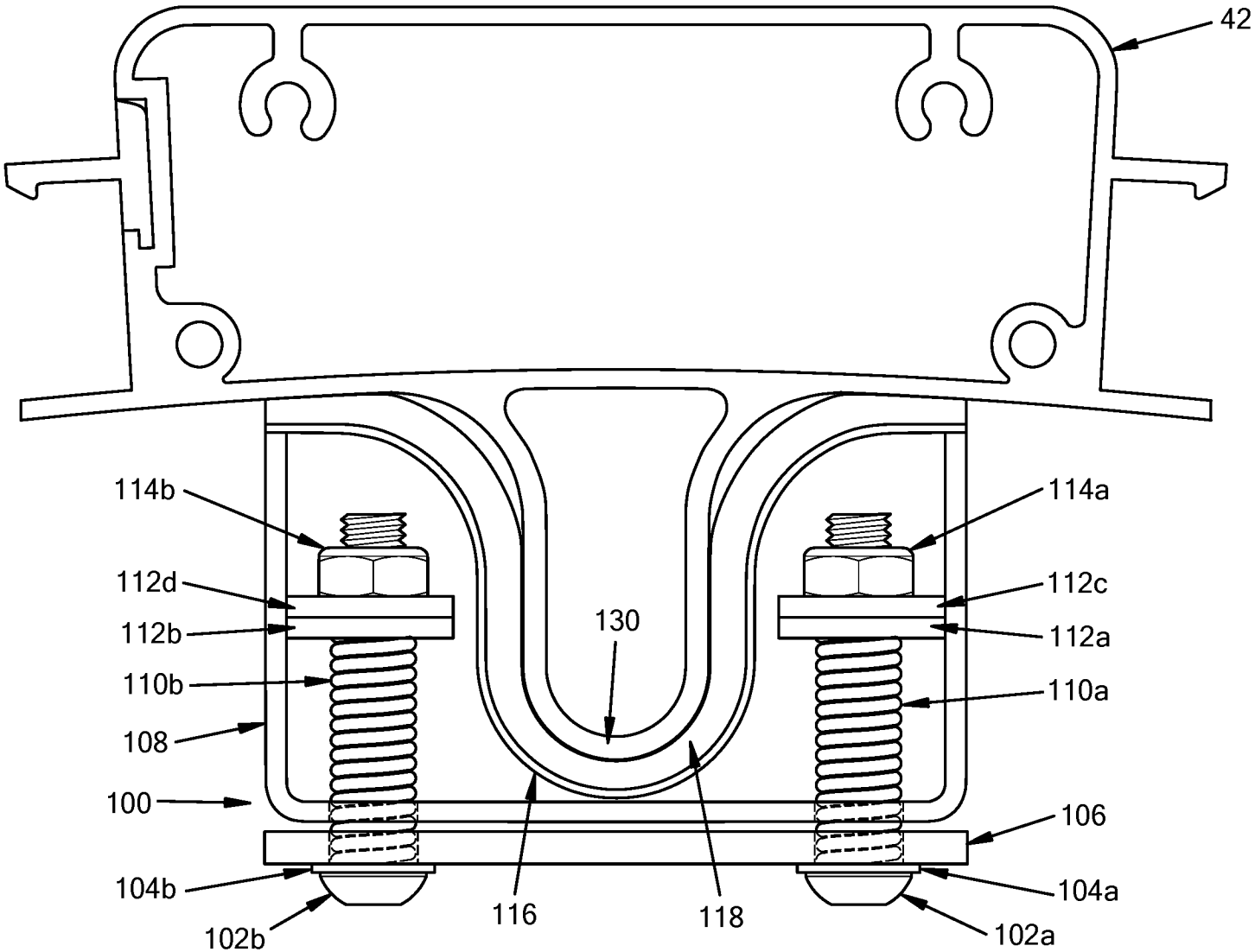
FIG. 8 shows a top view of the example cabin guide assembly and elevator column according to one or more embodiments of the present disclosure.

FIG. 8 shows a top view of the example cabin guide assembly 100 and elevator column 42 according to one or more embodiments of the present disclosure. Elevator column 42 may comprise a column rail 130 (e.g., integrated with or coupled to elevator column 42). Guide 116 and/or material layer 118 may be arranged to receive column rail 130 (and/or at least a portion of elevator column 42. In some embodiments, guide 116 and/or material layer 118 may be arranged to contact the exterior surface of column rail 130 and/or elevator column 42. For example, guide 116 and/or material layer 118 may be arranged to hug at least column rail 130 and/or elevator column 42. In some other embodiments, cabin guide assembly 100 is adjustable, where the force (e.g., hugging force, pressure, compression, etc.) that is exerted by cabin guide assembly 100 to column rail 130 (and/or elevator column 42) is adjustable. The force may have one or more values, i.e., the force is variable or adjustable. The force is adjustable at least by tightening and/or loosening one or both of nuts 114*a*, 114*b*, which adjusts the tension provided by springs 110*a*, 110*b*, respectively. In some embodiments, the force is based on one or more characteristics of one or more components of cabin guide assembly 100, such as the spring constant of springs 110, bolt length, distance between the bolt plates 112 and base surface 111, etc.

Figure 9:
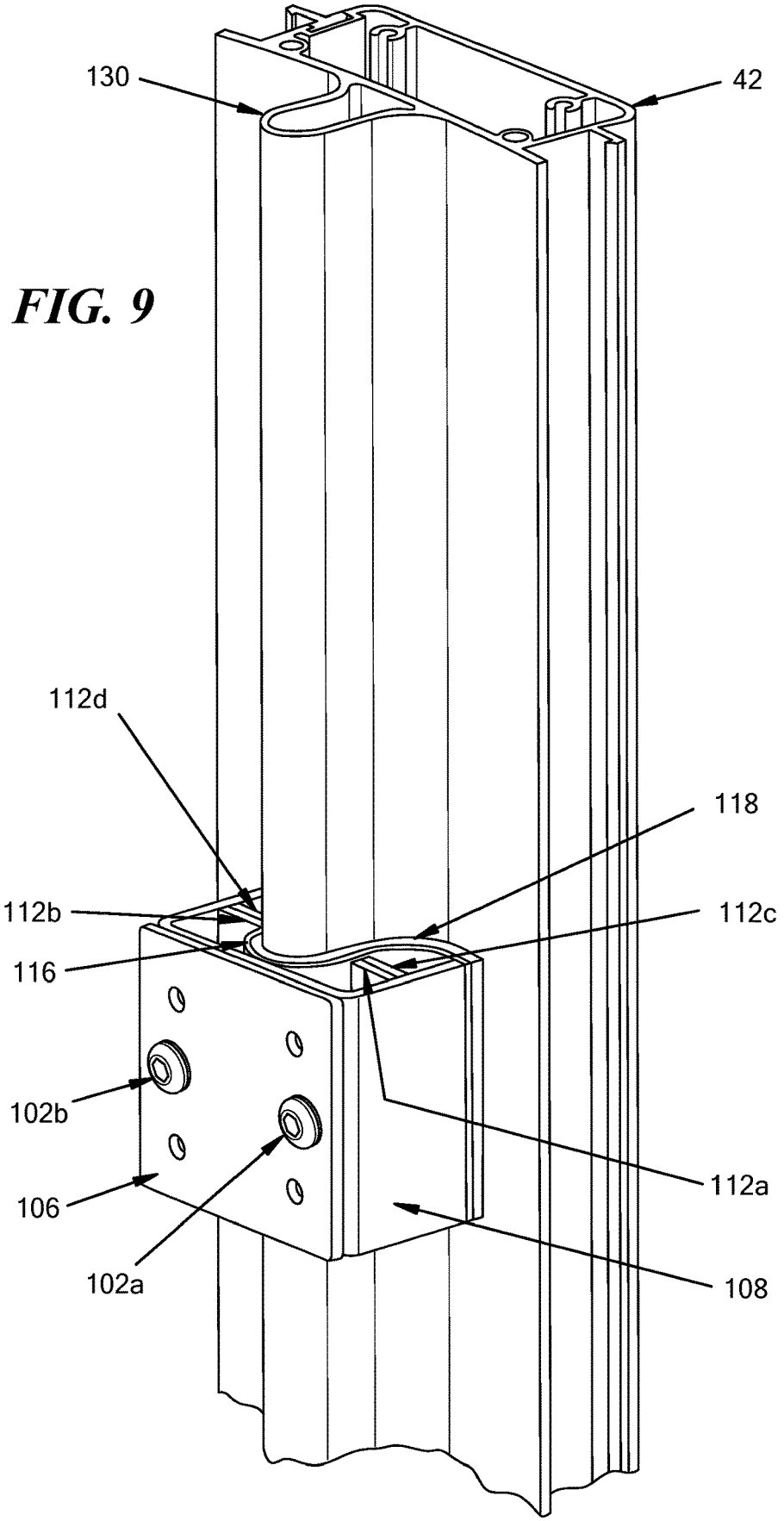
FIG. 9 shows a perspective view of the example cabin guide assembly and elevator column according to one or more embodiments of the present disclosure.

FIG. 9 shows a perspective view of the example cabin guide assembly 100 and elevator column 42 according to one or more embodiments of the present disclosure. In this nonlimiting example, guide 116 and/or material layer 118 received column rail 130 (and/or at least a portion of elevator column 42 and is in contact with the exterior surface of column rail 130 and/or elevator column 42 (e.g., hugging at least column rail 130 and/or elevator column 42). Cabin guide assembly 100 is arranged to move in the ascent direction and descent direction 24 such as when coupled to cabin 14 and cabin moves vertically, while elevator column 42 and column rail 130 remain static.

Figure 10:
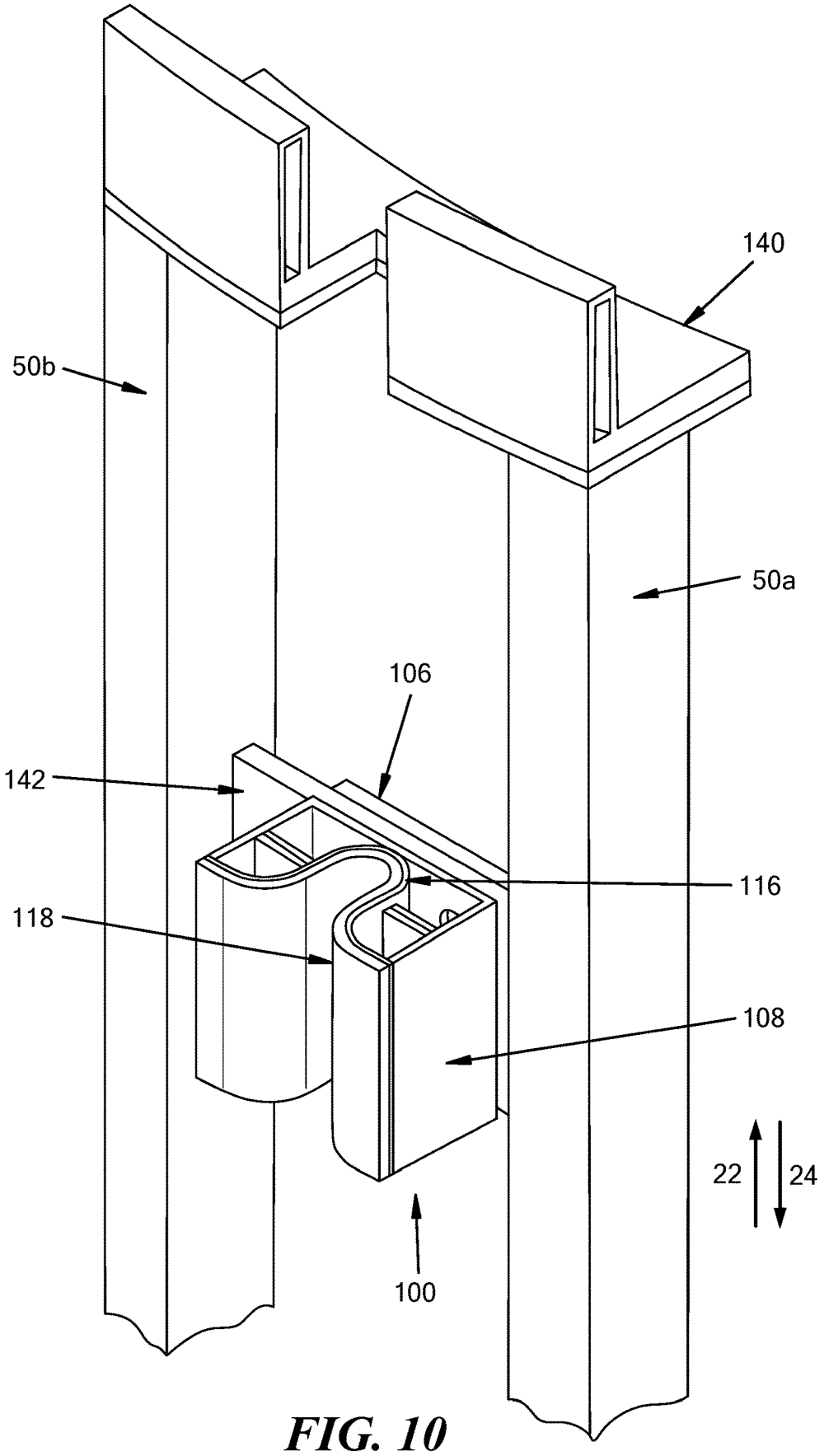
FIG. 10 shows a perspective view of the example cabin guide assembly and cabin column according to one or more embodiments of the present disclosure.
Figure 11:
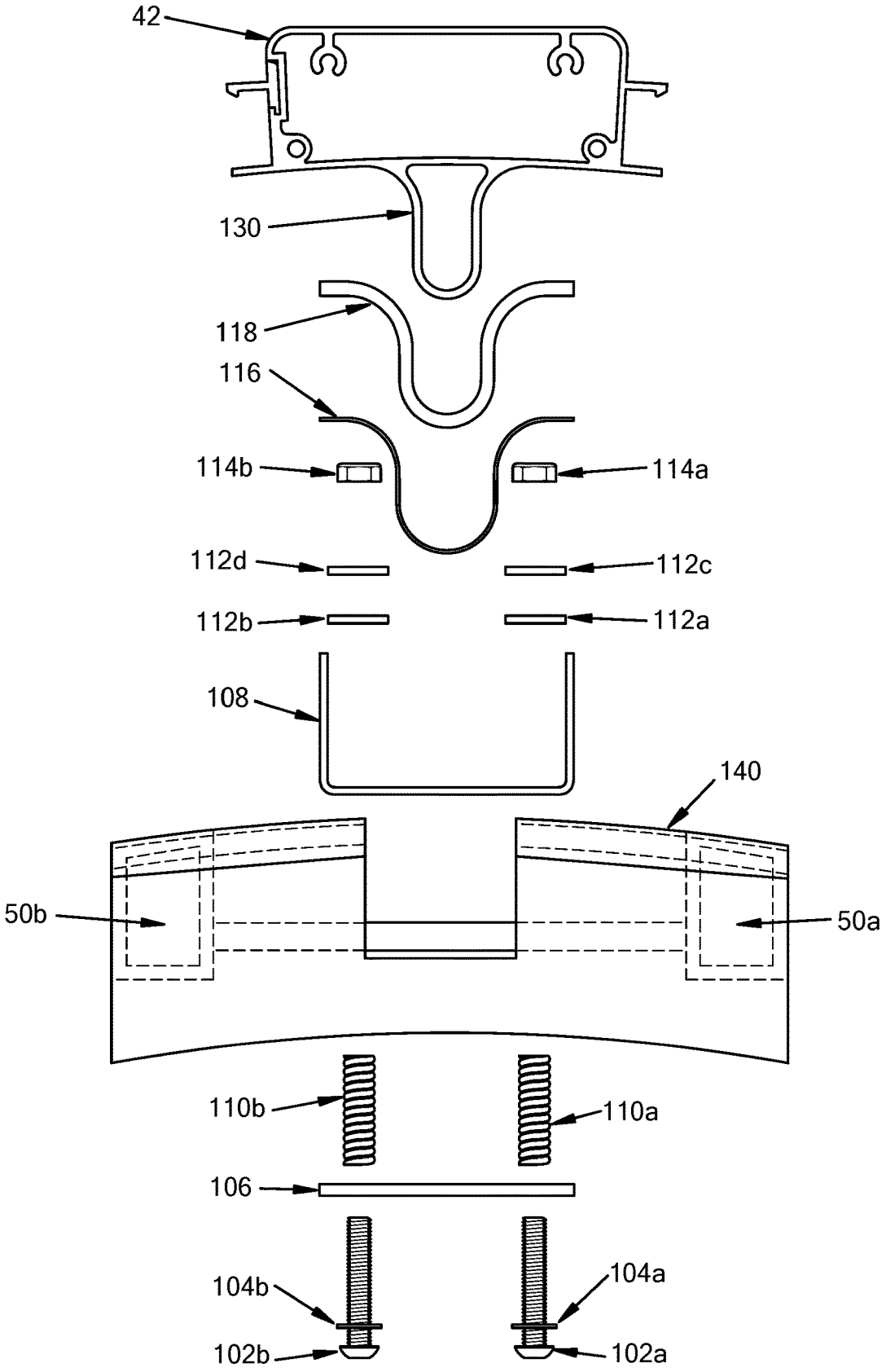
FIG. 11 shows a top view (exploded view) of the example cabin guide assembly, elevator column, and cabin column according to one or more embodiments of the present disclosure.
Figure 12:
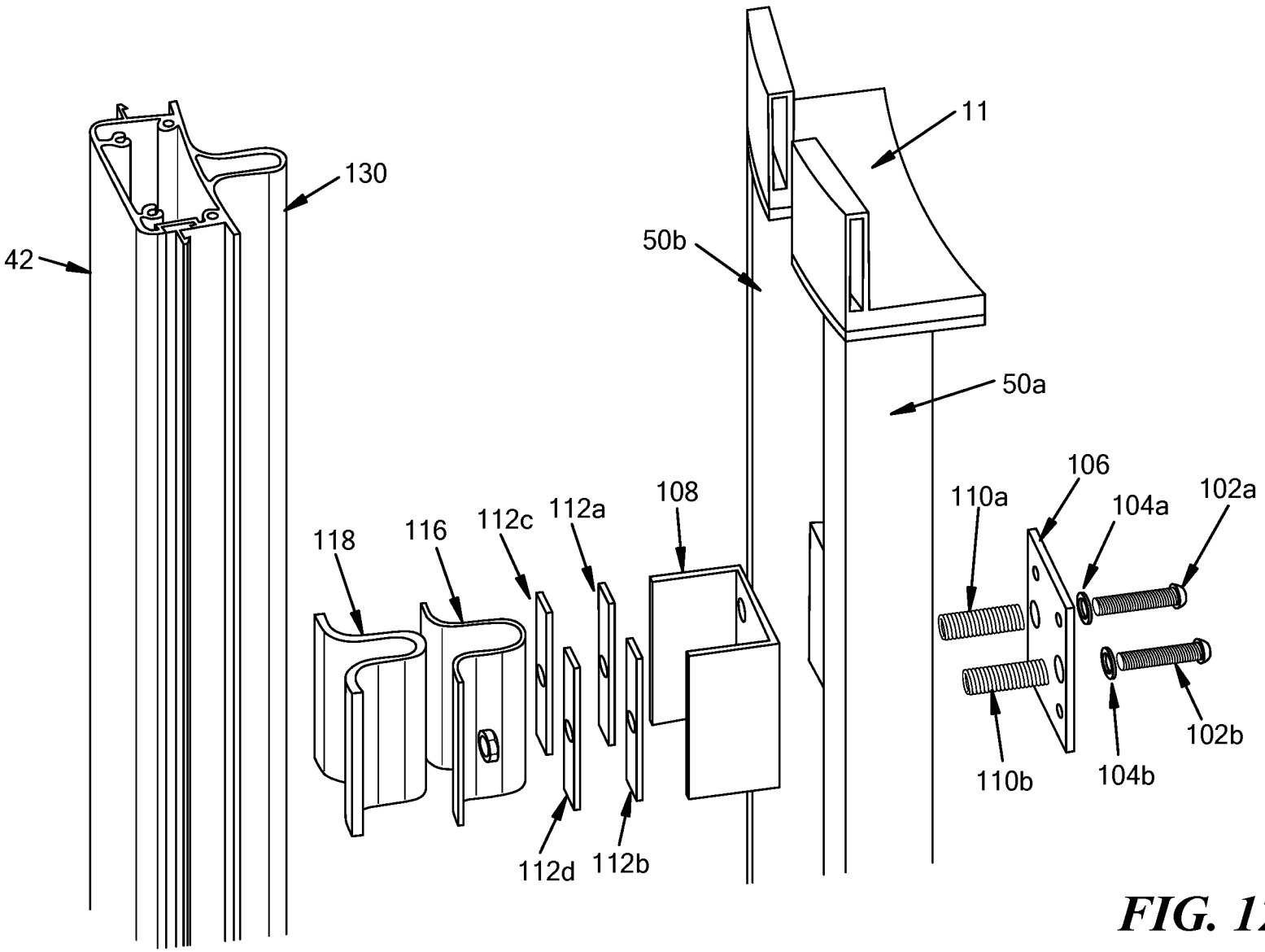
FIG. 12 shows a perspective view of the example cabin guide assembly, elevator column, and cabin column according to one or more embodiments of the present disclosure.

FIG. 10 shows a perspective view of the example cabin guide assembly 100 and cabin columns 50*a*, 50*b* according to one or more embodiments of the present disclosure. Bridge 140 may be coupled to cabin columns 50*a*, 50*b* and arranged to couple to other components of cabin 14. Further, cabin columns 50*a*, 50*b* may be coupled to column plate 142. Cabin guide assembly 100 may be mounted on column plate 142 of cabin 14, where base 108 contacts a first surface of column plate 142, and support plate 106 contacts a second surface (opposite to the first surface) of column plate 142. Cabin guide assembly 100 is secured to support plate 106 such as by using bolts 102, support plate 106, base 108, and nuts 114. FIG. 11 shows a top view (exploded view) of the example cabin guide assembly 100, elevator column 42, and cabin column 50 according to one or more embodiments of the present disclosure. FIG. 12 shows a perspective view of the example cabin guide assembly, elevator column, and cabin column according to one or more embodiments of the present disclosure.

Figure 13:
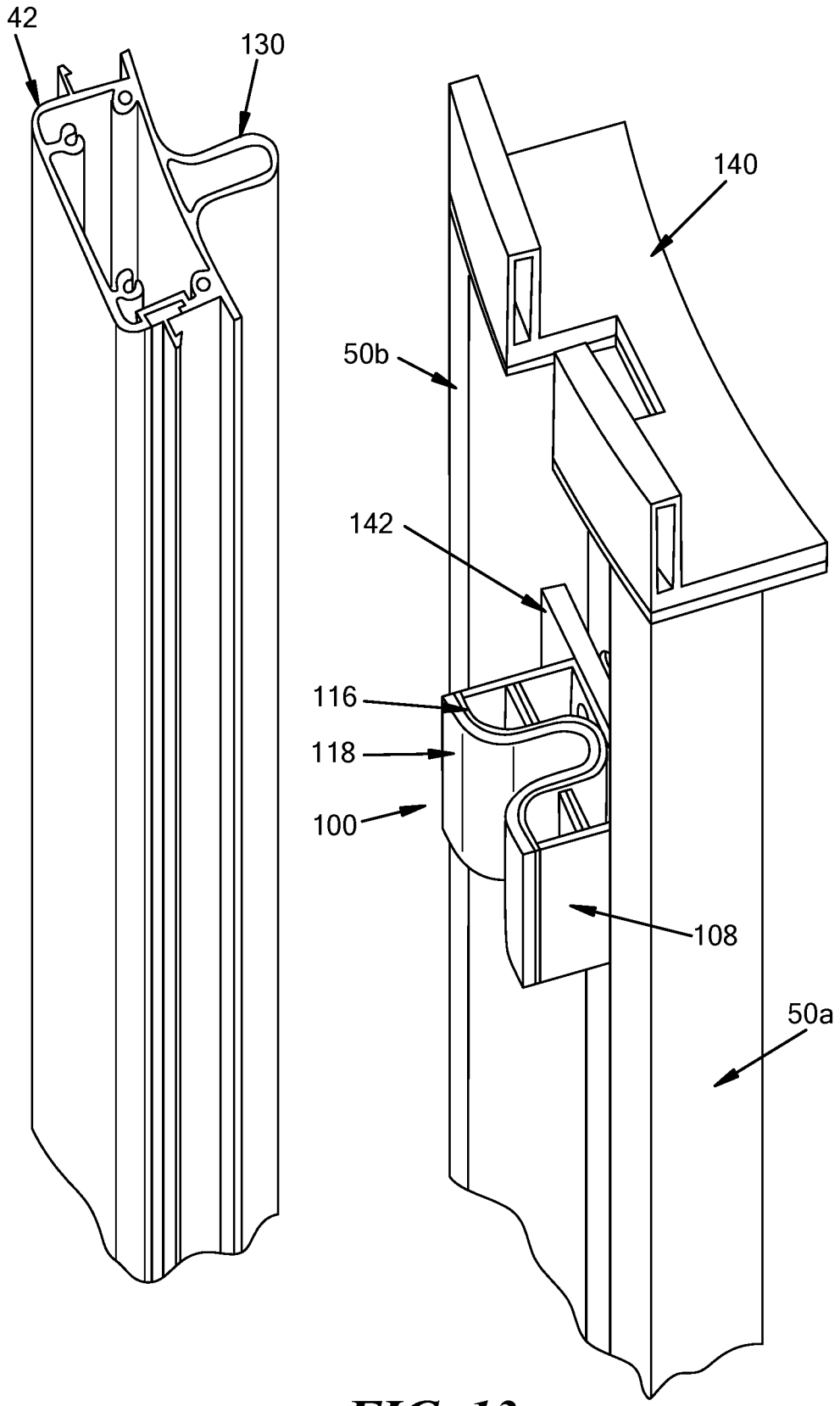
FIG. 13 shows a perspective view of the example cabin guide assembly (assembled), elevator column, and cabin column according to one or more embodiments of the present disclosure.
Figure 14:
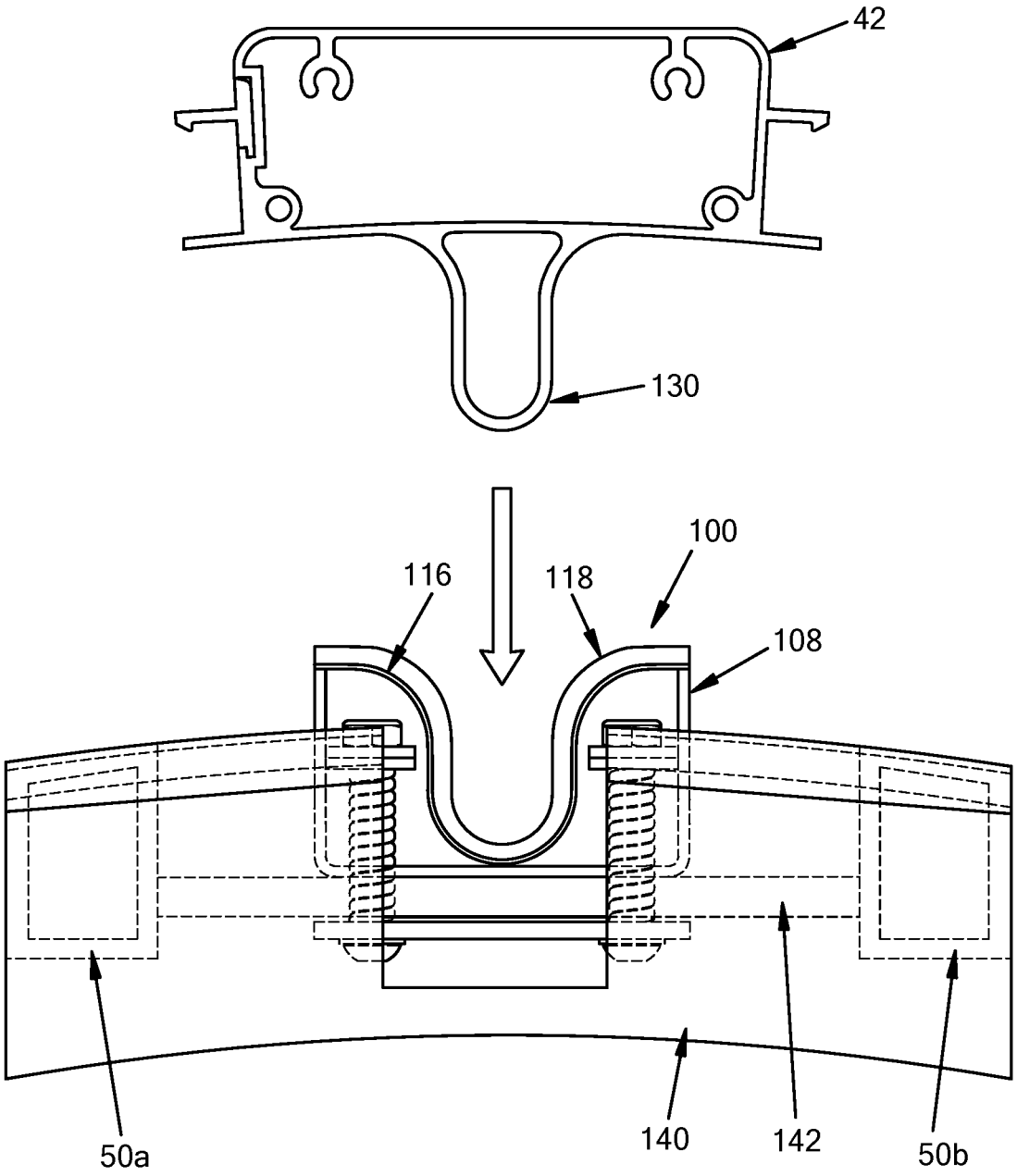
FIG. 14 shows a top view of the example cabin guide assembly (assembled), elevator column, and cabin column according to one or more embodiments of the present disclosure.

FIG. 13 shows a perspective view of the example cabin guide assembly 100 (assembled), elevator column 42, and cabin columns 50*a*, 50*b* according to one or more embodiments of the present disclosure. More specifically, cabin guide assembly 100 is coupled to cabin columns 50*a*, 50*b* of cabin 14 (e.g., secured to cabin 14) and arranged to receive at least column rail 130 (via guide 116 and material layer 118). Guide 116 and material layer 118 are arranged to conform to the shape of column rail 130, such that guide 116 and material layer 118 hug column rail 130. As cabin guide assembly 100 is adjustable, guide 116 and material layer 118 may be caused to exert a predetermined force to cabin rail 130 by tightening or loosening bolts 102 and nuts 114, e.g., based on characteristics of column rail 130, for alignment of cabin 14 with column rails 130, etc. FIG. 14 shows a top view of the example cabin guide assembly 100 assembly (assembled and coupled to column plate 142), elevator column 42, and cabin columns 50*a*, 50*b* (coupled by bridge 140) according to one or more embodiments of the present disclosure.

Figure 15:
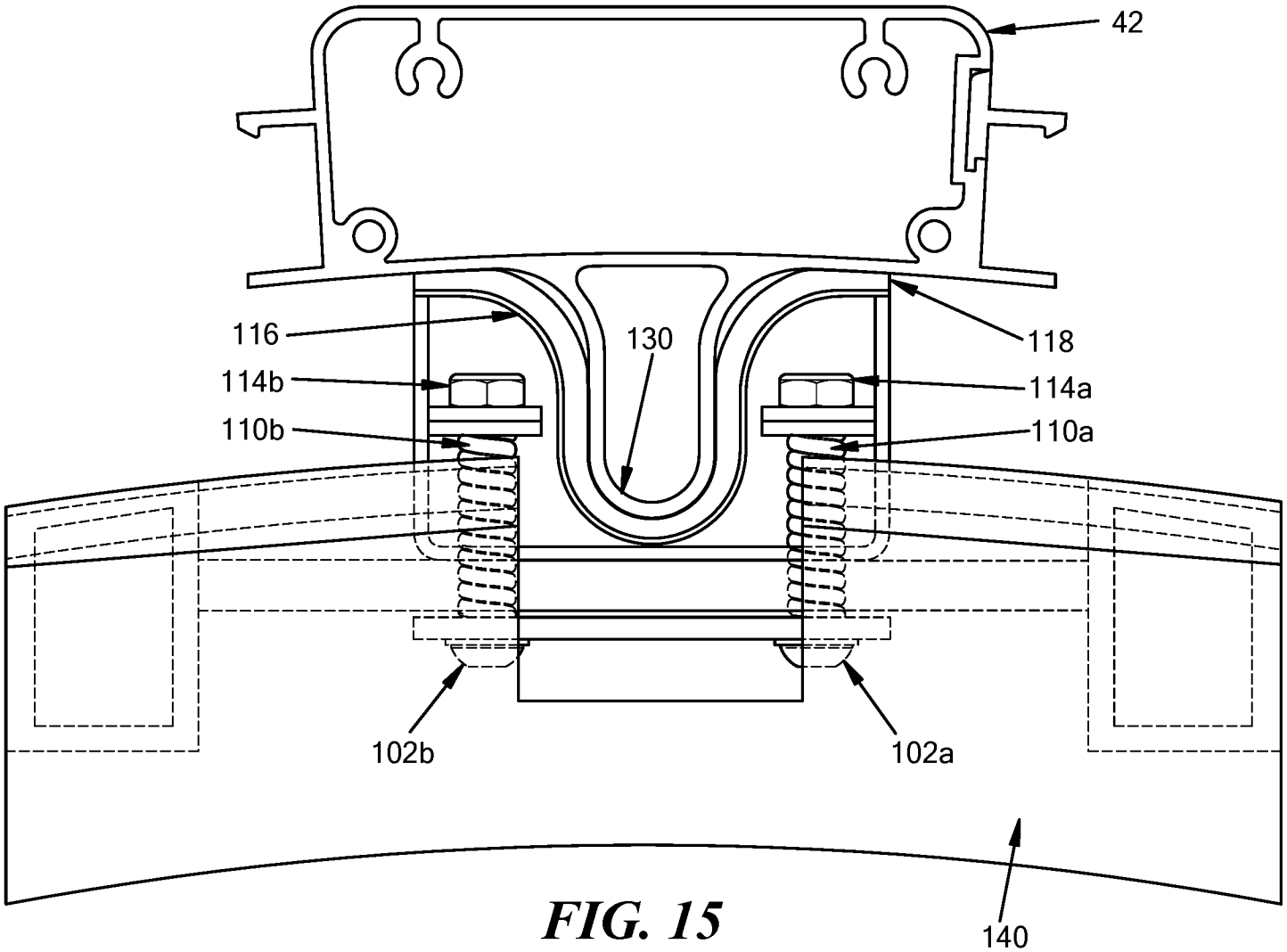
FIG. 15 shows a top view of the example cabin guide assembly (assembled) engaged with the elevator column according to one or more embodiments of the present disclosure.

FIG. 15 shows a top view of the example cabin guide assembly 100 engaged with the elevator column 42 (e.g., column rail 130) according to one or more embodiments of the present disclosure. In a nonlimiting example, one or both of nuts 114*a*, 114*b* may be fastened to adjust the engagement between elevator column 42 (e.g., column rail 130) and guide 116 (and material layer 118). In a nonlimiting example, nuts 114*a*, 114*b* are loosened to cause springs 110*a*, 110*b* to expand and indirectly push guide 116 (and material layer 118) against elevator column 42 (e.g., column rail 130). Nuts 114*a*, 114*b* may be tightened to cause springs 110*a*, 110*b* to contract and indirectly retract guide 116 (and material layer 118) away from elevator column 42 (e.g., column rail 130).

In some embodiments, cabin guide assembly 100 includes a U-shaped piece (i.e., guide 116 (and material layer 118 such as a carpet)) that firmly hugs the column rail. The U-shape provides stability to the cabin such as during ascent and descent, e.g., by absorbing energy transferred by cabin movement. Base 108 may be a square-like U-shaped base that serves as a foundation for cabin guide assembly 100, e.g., used to attach cabin guide assembly 100 to cabin column 50. Support plate 106 is mounted onto base 108 through cabin column 50 (via column plate 142) using spring-loaded bolts 102. These spring-loaded bolts 102 create tension on two internal plates which serves to push the U-shaped guide 116 as much as possible onto column rail 130. A firm embrace of cabin guide assembly 100 on column rail 130 results in smoother transport of the cabin 14 in the elevator 10 (when compared to conventional systems). A nut 114 (e.g., locknut) is used for both bolts 102 to maintain a secure fastening and prevent any loosening when the piece is exposed to the natural vibration and movement of the cabin 14 in the elevator 10.

In some embodiments, any of the components (or characteristics of the components) of cabin guide assembly 100 may be determined or modified to provide one or more functions described herein. In a nonlimiting example, bolts may have a size m4×38 millimeters (mm). The bolts 102 have respective washers 104 may have a thickness of 1 mm. Springs 110 may have an interior diameter of 4 mm used to create tension against the base 108. This tension serves to impose the material layer 118 (U-shaped carpet) as much as possible into column rail 130. The carpet may have a thickness of 4 mm. The U-shape may form an interior radius of 9 mm and an outer radius of 13 mm. Bolts 102 and compression springs 110 may travel through openings (7 mm) in support plate 106 and through an additional opening in the square-like U-shaped base 108 with a diameter of 13 mm. This spring and bolt encounter bolt plates 112, which may be welded to the sides of the square-like U-shaped base 108. The bolt plates 112 may share the same length and thickness (e.g., 2 mm) and have a centered opening with an 8 mm diameter. Bolt plates 112*a*, 112*b* may serve as a support surface for the compression springs 110*a*, 110*b*. The two upper bolt plates 112*c*, 112*d* may create a platform for the purpose of tightening the bolts 102*a*, 102*b* using nuts 114*a*, 114*b*. Although example characteristics of the components have been provided, the present disclosure is not limited as such, and any other characteristics may be applicable.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A cabin guide assembly, the cabin guide assembly comprising:

a material layer having a first material layer surface;

a guide having a first guide surface and a second guide surface opposite the first guide surface, the second guide surface being coupled to the first material layer surface;

a base coupled to at least a portion of the first guide surface; and one or more adjustment members coupled to the base and arranged to exert an adjustable force against the guide and the material layer;

a support plate having one or more support plate openings, the base including one or more base openings; and wherein each one of the one or more adjustment members includes:

a first bolt plate having a first bolt plate opening;

a second bolt plate positioned on the first bolt plate and having a second bolt plate opening, the first bolt plate and the second bolt plate being coupled to the base;

a nut having a nut opening, the nut opening being threaded;

a spring having a first spring end, a second spring end opposite the first spring end, and a spring interior;

a washer; and a bolt having a bolt head, a bolt tail, and a bolt threaded portion extending from the bolt tail toward the bolt head, the bolt being inserted through the washer, one support plate opening, one base opening, the spring interior, the first bolt plate opening, the second bolt plate opening, and the nut, the washer being positioned between the bolt head and the support plate, the first spring end being in contact with the washer, the second spring end being in contact with the first bolt plate.

2. The cabin guide assembly of claim 1, wherein the nut is arranged to receive at least a section of the bolt threaded portion via the nut opening.

3. The cabin guide assembly of claim 1, wherein the base has one or more interior side surfaces, each one of the first and second bolt plates have a plate coupler portion, the base has one or more base interior coupler portions on each interior side surface, and each adjustment member is coupled to the base by the plate coupler portion of each of the first and second bolt plates being coupled to the corresponding interior coupler portion of the base.

4. The cabin guide assembly of claim 1, wherein the adjustable force is adjustable from a first force value to a second force value different from the second force value by tightening or loosening the nut.

5. The cabin guide assembly of claim 1, wherein the base includes a first base end and a second base end, the guide includes a first guide end and a second guide end, and the base is coupled to at least the portion of the first guide surface by the first base end being coupled to the first guide end and the second base end being coupled to the second guide end.

6. The cabin guide assembly of claim 1, wherein the base is U-shaped and is arranged to receive at least a portion of the guide and the material layer between two of the one or more adjustment members.

7. The cabin guide assembly of claim 1, wherein the guide is U-shaped, and the second guide surface is coupled to the first material layer surface by adhering to the first material layer surface.

8. The cabin guide assembly of claim 7, wherein the material layer is U-shaped when the second guide surface adheres to the first material layer surface, the material layer having a predetermined thickness.

9. A cabin guide assembly, the cabin guide assembly comprising:

a material layer having a first material layer surface;

a guide having a first guide surface and a second guide surface opposite the first guide surface, the second guide surface being coupled to the first material layer surface;

a base coupled to at least a portion of the first guide surface, the base including one or more base openings;

a support plate having one or more support plate openings; and one or more adjustment members inserted through a corresponding base opening and a corresponding support plate opening, the one or more adjustment members being coupled to the base and arranged to exert an adjustable force against the guide and the material layer;

wherein each one of the one or more adjustment members includes:

a first bolt plate having a first bolt plate opening;

a second bolt plate positioned on the first bolt plate and having a second bolt plate opening, the first bolt plate and the second bolt plate being coupled to the base;

a nut having a nut opening, the nut opening being threaded;

a spring having a first spring end, a second spring end opposite the first spring end, and a spring interior;

a washer; and a bolt having a bolt head, a bolt tail, and a bolt threaded portion extending from the bolt tail toward the bolt head, the bolt being inserted through the washer, one support plate opening, one base opening, the spring interior, the first bolt plate opening, the second bolt plate opening, and the nut, the washer being positioned between the bolt head and the support plate, the first spring end being in contact with the washer, the second spring end being in contact with the first bolt plate.

10. The cabin guide assembly of claim 9, wherein the nut is arranged to receive at least a section of the bolt threaded portion via the nut opening.

11. The cabin guide assembly of claim 9, wherein the base has one or more interior side surfaces, each one of the first and second bolt plates have a plate coupler portion, the base has one or more base interior coupler portions on each interior side surface, and each adjustment member is coupled to the base by the plate coupler portion of each of the first and second bolt plates being coupled to the corresponding interior coupler portion of the base.

12. The cabin guide assembly of claim 9, wherein the adjustable force is adjustable from a first force value to a second force value different from the second force value by tightening or loosening the nut.

13. The cabin guide assembly of claim 9, wherein the base includes a first base end and a second base end, the guide includes a first guide end and a second guide end, and the base is coupled to at least the portion of the first guide surface by the first base end being coupled to the first guide end and the second base end being coupled to the second guide end.

14. The cabin guide assembly of claim 9, wherein the base is U-shaped and is arranged to receive at least a portion of the guide and the material layer between two of the one or more adjustment members.

15. The cabin guide assembly of claim 9, wherein the guide is U-shaped, and the second guide surface is coupled to the first material layer surface by adhering to the first material layer surface.

16. The cabin guide assembly of claim 15, wherein the material layer is U-shaped when the second guide surface adheres to the first material layer surface, the material layer having a predetermined thickness.

17. An elevator comprising:

an elevator structure including a plurality of elevator columns, each elevator column of the plurality of elevator columns including a column rail;

a cabin movable within the elevator structure;

a plurality of cabin guide assemblies, each cabin guide assembly of the plurality of cabin guide assemblies coupled to the cabin and comprising:

a material layer having a first material layer surface and a second material layer surface opposite the first material layer surface, the second material layer surface being arranged to contact receive and contact a corresponding column rail;

a guide having a first guide surface and a second guide surface opposite the first guide surface, the second guide surface being coupled to the first material layer surface;

a base coupled to at least a portion of the first guide surface, the base including one or more base openings; and a support plate coupled to the cabin and having one or more support plate openings; and one or more adjustment members inserted through a corresponding base opening and a corresponding support plate opening, the one or more adjustment members being coupled to the base and arranged to exert an adjustable force against the guide and the material layer, at least a portion of the second material layer surface contacting and pressing against the corresponding column rail when the adjustable force is exerted;

wherein each one of the one or more adjustment members includes:

a first bolt plate having a first bolt plate opening;

a second bolt plate positioned on the first bolt plate and having a second bolt plate opening, the first bolt plate and the second bolt plate being coupled to the base;

a nut having a nut opening, the nut opening being threaded;

a spring having a first spring end, a second spring end opposite the first spring end, and a spring interior;

a washer; and a bolt having a bolt head, a bolt tail, and a bolt threaded portion extending from the bolt tail toward the bolt head, the bolt being inserted through the washer, one support plate opening, one base opening, the spring interior, the first bolt plate opening, the second bolt plate opening, and the nut, the washer being positioned between the bolt head and the support plate, the first spring end being in contact with the washer, the second spring end being in contact with the first bolt plate.

* * * * *